US011322879B2

(12) United States Patent
Hiramatsu et al.

(10) Patent No.: US 11,322,879 B2
(45) Date of Patent: May 3, 2022

(54) SEALING CONNECTOR

(71) Applicant: SUMITOMO WIRING SYSTEMS, LTD., Mie (JP)

(72) Inventors: Kazuki Hiramatsu, Mie (JP); Masakazu Suzuki, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/088,774

(22) Filed: Nov. 4, 2020

(65) Prior Publication Data

US 2021/0151926 A1 May 20, 2021

(30) Foreign Application Priority Data

Nov. 15, 2019 (JP) ..... JP2019-207151

(51) Int. Cl.
*H01R 13/502* (2006.01)
*H01R 13/52* (2006.01)
*H01R 13/436* (2006.01)

(52) U.S. Cl.
CPC ..... *H01R 13/5202* (2013.01); *H01R 13/4365* (2013.01); *H01R 13/502* (2013.01); *H01R 13/521* (2013.01); *H01R 13/5221* (2013.01)

(58) Field of Classification Search
CPC ..... H01R 13/5205; H01R 13/5202; H01R 13/4365; H01R 13/502; H01R 13/521; H01R 13/5221
See application file for complete search history.

(56) References Cited

U.S. PATENT DOCUMENTS

| | | | | |
|---|---|---|---|---|
| 5,252,092 | A * | 10/1993 | Reider | H01R 13/436 439/595 |
| 6,364,692 | B1 | 4/2002 | Okayasu et al. | |
| 7,244,133 | B2 * | 7/2007 | Muller | H01R 13/5202 439/272 |
| 7,727,016 | B2 * | 6/2010 | Lamdiziz | H01R 13/506 439/587 |
| 9,673,563 | B2 * | 6/2017 | Kataoka | H01R 13/5205 |
| 2021/0151930 | A1 * | 5/2021 | Hiramatsu | H01R 13/502 |
| 2021/0151936 | A1 * | 5/2021 | Hiramatsu | H01R 13/5025 |

FOREIGN PATENT DOCUMENTS

| | | |
|---|---|---|
| JP | 2001-110506 A | 4/2001 |
| JP | 2015-050178 A | 3/2015 |

* cited by examiner

*Primary Examiner* — Tho D Ta
(74) *Attorney, Agent, or Firm* — Abelman, Frayne & Schwab

(57) ABSTRACT

A connector is provided with a rear seal portion to be arranged to face a rear surface of a housing, and a rear wall portion to be arranged to face a rear surface of the rear seal portion. The housing includes a lock piece projecting rearward from the rear surface and the lock piece includes a lock portion on a tip side. The rear seal portion includes a lock-side seal hole to be held in close contact with a base end side of the lock piece and a sealing surface to be held in close contact with a mating housing on an outer peripheral side. The rear wall portion includes a lock receiving portion to be locked by the lock portion on an inner surface of a through hole. Out of an outer part and an inner part, the lock receiving portion is provided on the inner part.

7 Claims, 10 Drawing Sheets

SEALING CONNECTOR

CROSS-REFERENCE TO RELATED APPLICATIONS

This application is based on and claims priority from Japanese Patent Application No. 2019-207151, filed on Nov. 15, 2019, with the Japan Patent Office, the disclosure of which is incorporated herein in their entireties by reference.

TECHNICAL FIELD

The present disclosure relates to a connector.

BACKGROUND

A connector disclosed in Japanese Patent Laid-Open Publication No. 2000-348813 includes a female housing, a seal rubber plate to be arranged on a rear surface side of the female housing and a rear wall portion to be arranged on a rear surface side of the seal rubber plate. The rear surface of the female housing serves as a wire pull-out surface. The seal rubber plate includes a draw-out hole to be held in close contact with a wire. The rear wall portion is provided on a rubber plate presser. The rubber plate presser includes lock plates projecting forward from upper and lower end parts of the rear wall portion. The female housing includes lock projections corresponding to the respective lock plates on the upper and lower surfaces of the rear wall portion. The lock plates lock the lock projections, whereby the rubber plate presser is held on the female housing. The rubber plate presser is sandwiched between the rear wall portion of the rubber plate presser and the female housing.

In the case of Japanese Patent Laid-Open Publication No. 2000-348813, a waterproof rubber ring is provided between the female housing and a male housing as a connection partner of the female housing, and sealing is provided in a liquid-tight manner between the both housings via the waterproof rubber ring. In contrast, if the waterproof rubber ring is integrated with the seal rubber plate, it is preferable since the number of components can be reduced. For example, a seal member disclosed in Japanese Patent Laid-Open Publication No. 2015-050178 includes a lip portion to be held in close contact with a male housing (mating housing) on an outer periphery and a wire insertion hole to be held in close contact with a wire. In the case of Japanese Patent Laid-Open Publication No. 2015-050178, since it is not necessary to provide a waterproof rubber ring separately from the seal member, the number of components can be reduced. A connector with a waterproof structure is also disclosed in Japanese Patent Laid-Open Publication No. 2001-110506.

SUMMARY

In Japanese Patent Laid-Open Publication No. 2015-050178, the housing can also be structured such that a lock piece projects rearward therefrom. In this case, a tip side of the lock piece is locked to a rear wall portion, and a base end side of the lock piece is arranged through a hole of the seal member. Then, there is a concern that the seal member is resiliently deformed inwardly and, simultaneously, the base end side of the lock piece is displaced inwardly when the mating housing is strongly held in close contact with the outer periphery of the seal member. As a result, there is a concern that the tip side of the lock piece and the rear wall portion are inadvertently unlocked.

Accordingly, the present disclosure aims to provide a connector having improved assembly reliability of a sealing structure.

The present disclosure is directed to a connector with a housing, a rear seal portion to be arranged to face a rear surface of the housing, and a rear wall portion to be arranged to face a rear surface of the rear seal portion, wherein the housing includes a lock piece projecting rearward from the rear surface and the lock piece includes a lock portion on a tip side, the rear seal portion includes a lock-side seal hole to be held in close contact with a base end side of the lock piece and a sealing surface to be held in close contact with a mating housing as a connection partner of the housing on an outer peripheral side, the rear wall portion includes a through hole, the tip side of the lock piece being arranged in the through hole, and a lock receiving portion to be locked by the lock portion on an inner surface of the through hole and, out of an outer part near the sealing surface and an inner part distant from the sealing surface on the inner surface of the through hole, the lock receiving portion is provided on the inner part.

According to the present disclosure, it is possible to provide a connector having improved assembly reliability of a sealing structure.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
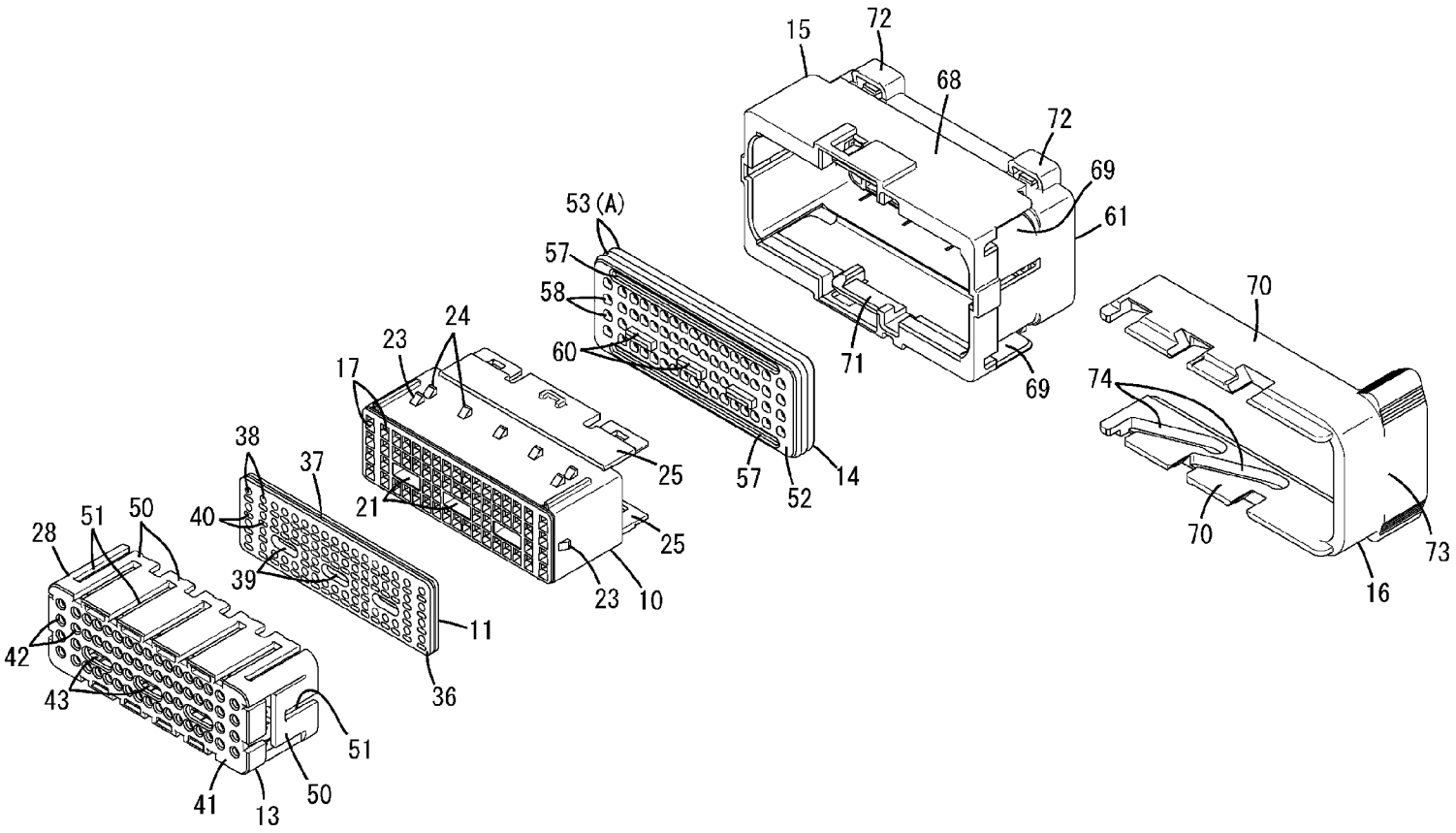
FIG. 1 is an exploded perspective view of a connector according to one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The connector of the present disclosure is provided with a housing, a rear seal portion to be arranged to face a rear surface of the housing, and a rear wall portion to be arranged to face a rear surface of the rear seal portion, wherein the housing includes a lock piece projecting rearward from the rear surface and the lock piece includes a lock portion on a tip side, the rear seal portion includes a lock-side seal hole to be held in close contact with a base end side of the lock piece and a sealing surface to be held in close contact with a mating housing as a connection partner of the housing on an outer peripheral side, the rear wall portion includes a through hole, the tip side of the lock piece being arranged in the through hole, and a lock receiving portion to be locked by the lock portion on an inner surface of the through hole and, out of an outer part near the sealing surface and an inner part distant from the sealing surface on the inner surface of the through hole, the lock receiving portion is provided on the inner part. According to this configuration, if the mating housing is held in close contact with the sealing surface and an inward deformation force is applied to the rear seal portion, the base end side of the lock piece is displaced inwardly. Thus, the lock portion on the tip side can strongly lock the lock receiving portion provided on the inner part of the through hole. As a result, a state where the rear seal portion is arranged between the housing and the rear wall portion can be satisfactorily maintained.

(2) Preferably, the lock portion is plate-like and includes a lock hole, and the lock receiving portion has a projection shape to be fit into the lock hole. The lock receiving portion having the projection shape is fit into the lock hole, whereby the locking of the lock portion and the lock receiving portion can be satisfactorily maintained. When the mating housing is held in close contact with the sealing surface, the plate-like lock portion can satisfactorily receive a resilient restoring force of the rear seal portion. Thus, the sealability of the rear seal portion can be stably maintained.

(3) The housing may include, on an outer peripheral surface, a covering portion and a step arranged to face forward on a rear side of the covering portion, a peripheral wall of a front member may be arranged on the covering portion, the step may be facing a tip of the peripheral wall, and the lock piece may be provided to be continuous with a rear side of the step. In mounting a front member on a housing, a covering portion is provided on an outer peripheral surface of the housing and a step is provided behind the covering portion in many cases. Conventionally, there has been a problem that a part of the housing behind the step is wasted (dead space). On the other hand, according to this configuration, since the lock piece is provided to be continuous with the rear side of the step, a part behind the step can be effectively utilized without being wasted.

Details of Embodiment of Present Disclosure

Hereinafter, a specific example of the connector of the present disclosure is described with reference to the drawings. Note that the present invention is not limited to these illustrations and is intended to be represented by claims and include all changes in the scope of claims and in the meaning and scope of equivalents.

Embodiment

A connector of one embodiment includes, as shown in FIG. 1, a housing 10, a front seal 11, a front member 13, a rear seal 14, a frame 15 and a lever 16. Note that, in the following description, a front-rear direction and a vertical direction are based on a front-rear direction and a vertical direction in an exploded perspective view of FIG. 1.

<Housing>

Figure 2:
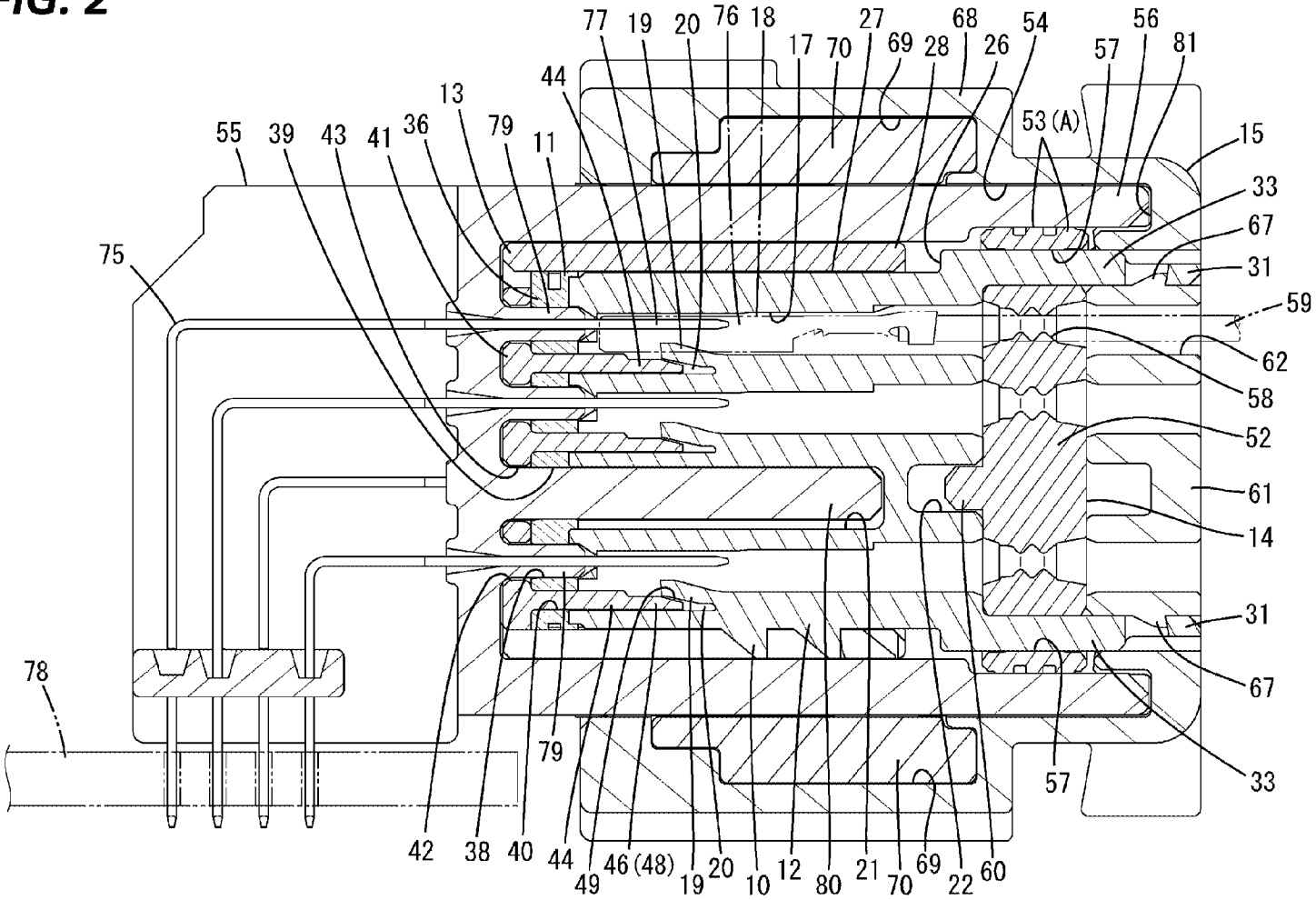
FIG. 2 is a side view in section cut at the position of cavities in the connector connected to a mating housing.
Figure 5:
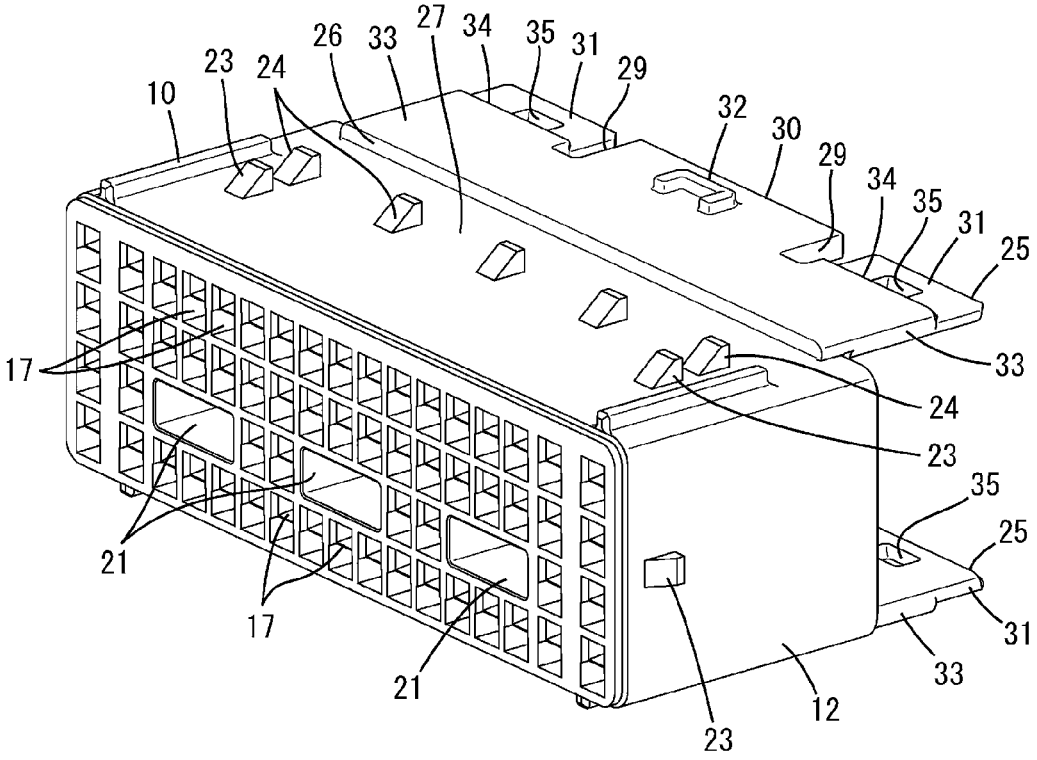
FIG. 5 is a perspective view of a housing viewed obliquely from an upper-front side.
Figure 6:
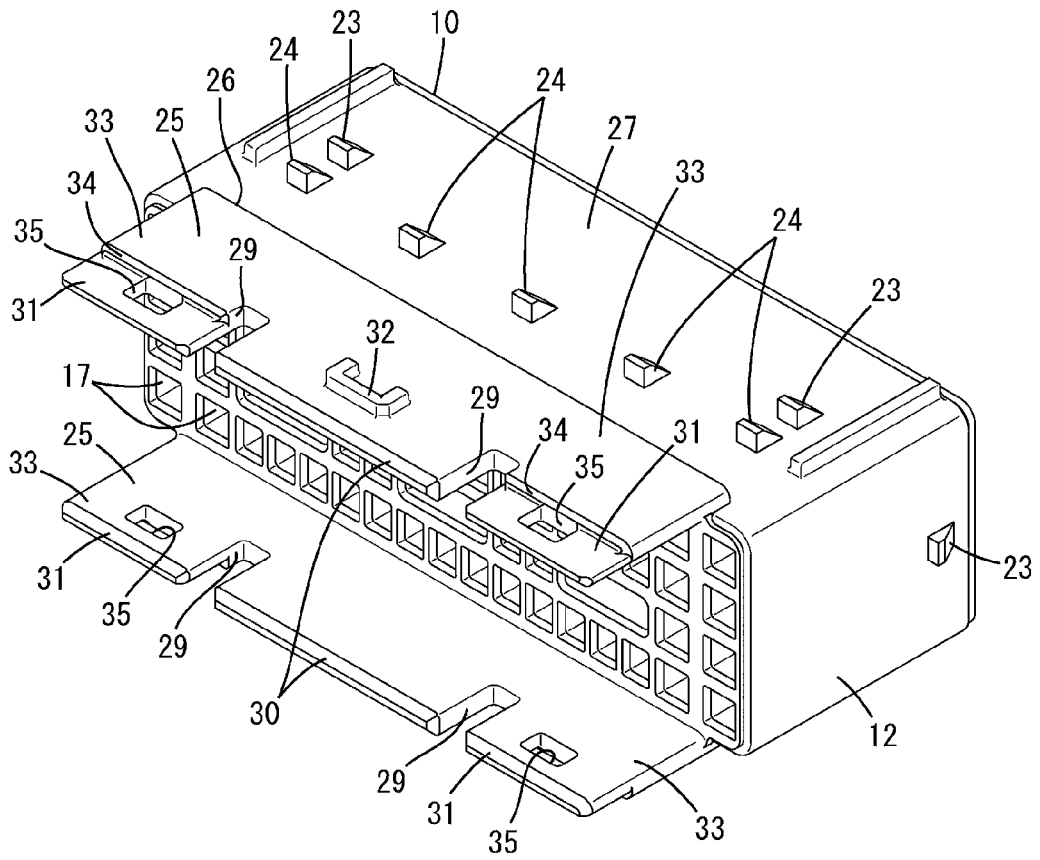
FIG. 6 is a perspective view of the housing viewed obliquely from an upper-rear side.

The housing 10 is made of synthetic resin and includes, as shown in FIGS. 5 and 6, a housing body 12 in the form of a laterally long rectangular block. The housing body 12 includes a plurality of cavities 17. As shown in FIG. 2, a terminal fitting 18 is inserted into each cavity 17 from behind. A plurality of the cavities 17 extending in the front-rear direction are vertically and laterally arranged in the housing body 12. The housing body 12 includes locking lances 19 projecting forward from inner surfaces (lower surfaces in a shown example) of the respective cavities 17. The housing body 12 includes space portions 20 below the locking lances 19. The locking lance 19 is deflectable and deformable into the space portion 20 with a base end part as a fulcrum.

As shown in FIG. 5, the housing body 12 includes a plurality of erroneous assembly preventing holes 21 between the respective cavities 17. The respective erroneous assembly preventing holes 21 are laterally arranged at intervals in a lower part of the housing body 12. The erroneous assembly preventing holes 21 are open in the front surface of the housing body 12. Further, as shown in FIG. 2, the housing body 12 includes positioning holes 22 facing rear sides of the erroneous assembly preventing holes 21 via separation wall parts. The positioning holes 22 are open in the rear surface of the housing body 12.

As shown in FIGS. 5 and 6, partial locking portions 23 and full locking portions 24 are provided to project on the upper and lower surfaces of the housing body 12. The full locking portion 24 is in the form of a claw and a plurality of (five in a shown example) full locking portions 24 are provided laterally side by side on a rear end part of each of the upper and lower surfaces of the housing body 12. The partial locking portion 23 is similarly in the form of a claw and a pair of the partial locking portions 23 are provided in front of the full locking portions 24 on both left and right sides in an intermediate part in the front-rear direction of each of the upper and lower surfaces of the housing body 12. The partial locking portions 23 are also provided on front end parts of left and right side surfaces of the housing body 12.

As shown in FIGS. 5 and 6, the housing 10 includes a pair of upper and lower plate-like portions 25 projecting rearward from the housing body 12. The plate-like portions 25 are in the form of laterally long rectangular plates and front end parts thereof are provided to overlap on rear end parts of the upper and lower surfaces of the housing body 12. Steps 26 are formed between the front ends of the plate-like portions 25 and the upper and lower surfaces of the housing body 12. The steps 26 extend along a lateral direction and are arranged to face forward.

The upper and lower surfaces of the housing body 12 include covering portions 27 in front of the steps 26. The covering portions 27 are formed to be flat in the front-rear and lateral directions except at formation positions of the partial locking portions 23 and the full locking portions 24. As shown in FIG. 2, the covering portions 27 are covered by a later-described peripheral wall 28 of the front member 13.

As shown in FIG. 6, the upper and lower plate-like portions 25 include rectangular flat plate parts continuous in the lateral direction on base end sides connected to the housing body 12. Both left and right ends of the base end side of the plate-like portion 25 are rounded into a semicircular shape. On the other hand, each of the upper and lower plate-like portions 25 includes, on a tip side distant from the housing body 12, a pair of left and right cut grooves 29, an intermediate plate portion 30 arranged laterally inward of the respective cut grooves 29 and lock portions 31 arranged laterally outward of the respective cut grooves 29. Each cut groove 29 extends in the front-rear direction and is open in the rear end of the plate-like portion 25. A retaining projection 32 in the form of a gate-shaped rib is provided in a laterally central part of the upper surface of the intermediate plate portion 30.

The housing 10 includes lock pieces 33 continuous in the front-rear direction from the base end sides of the plate-like portions 25 to the lock portions 31 in both left and right end parts. The lock piece 33 has a laterally extending stepped surface 34 on the lock portion 31. A part of the lock portion 31 behind the stepped surface 34 is formed to be thinner than a front part. The lock portion 31 is vertically deflectable and deformable with a part on the side of the stepped surface 34 as a fulcrum.

A rectangular lock hole 35 is open in a laterally central part of the lock portion 31. The front end of the lock hole 35 is continuous with the stepped surface 34.

<Front Seal>

The front seal 11 is made of rubber such as silicon rubber and includes, as shown in FIG. 2, a front seal portion 36 facing the front surface of the housing body 12. The front seal portion 36 is in the form of a laterally long rectangular mat and can cover the front surface of the housing body 12. As shown in FIG. 1, an outer peripheral lip 37 is provided on the outer peripheral surface of the front seal portion 36. The outer peripheral lip 37 is provided over the entire periphery on the outer peripheral surface of the front seal portion 36.

Figure 4:
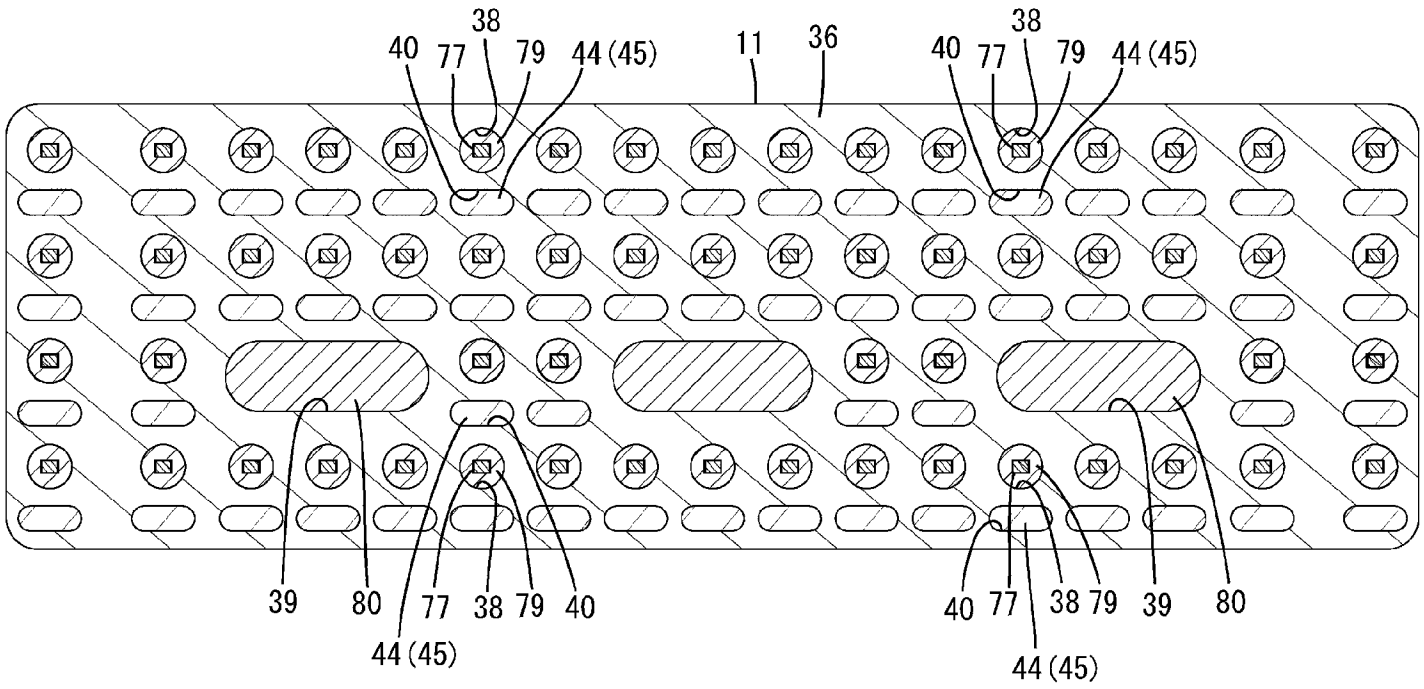
FIG. 4 is a transverse section cut at the position of a front seal portion in the connector connected to the mating housing.

The front seal portion 36 includes terminal-side seal holes 38 at positions communicating with the respective cavities 17. As shown in FIG. 4, the terminal-side seal hole 38 has a circular cross-sectional shape, particularly a truly circular cross-sectional shape.

The front seal portion 36 includes erroneous assembly preventing seal holes 39 at positions communicating with the erroneous assembly preventing holes 21. As shown in FIG. 4, the erroneous assembly preventing seal hole 39 is formed to be laterally long. Both left and right sides of the erroneous assembly preventing seal hole 39 are rounded into a semicircular shape.

Further, the front seal portion 36 includes detection-side seal holes 40 at positions communicating with the respective space portions 20. As shown in FIG. 4, the respective detection-side seal holes 40 are arranged between the vertically arranged terminal-side seal holes 38 and below the terminal-side seal holes 38 on a lower end. In short, the respective detection-side seal holes 40 are arranged below and adjacent to the respective terminal-side seal holes 38. The respective terminal-side seal holes 38 and the respective detection-side seal holes 40 are alternately arranged side by side on the same axes in the vertical direction (arrangement direction of the terminal-side seal holes 38).

The detection-side seal hole 40 has an elliptical cross-sectional shape long in the lateral direction and short in the vertical direction. Note that the "elliptical shape" of the present disclosure includes an oval shape such as an egg shape long in the lateral direction. A vertical distance between the detection-side seal hole 40 and the terminal-side seal hole 38 adjacent to this detection-side seal hole 40 is equal to or longer than a lateral distance between the adjacent detection-side seal holes 40. Although not shown in detail, any of the terminal-side seal holes 38, the erroneous assembly preventing seal holes 39 and the detection-side seal holes 40 includes a lip part continuous in a circumferential direction.

<Front Member>

The front member 13 is made of synthetic resin and includes, as shown in FIG. 2, a front wall portion 41 facing the front surface of the front seal portion 36. The front wall portion 41 is in the form of a laterally long rectangular plate and can cover the front surface of the front seal portion 36.

Figure 7:
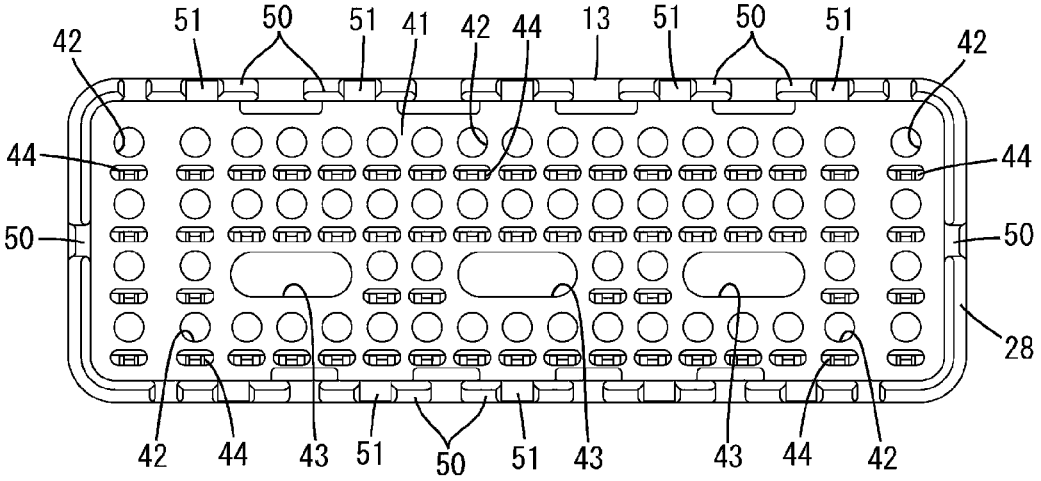
FIG. 7 is a back view of a front member.

The front wall portion 41 includes terminal-side insertion holes 42 at positions communicating with the respective terminal-side seal holes 38. As shown in FIG. 7, the terminal-side insertion hole 42 has a circular cross-sectional shape, particularly a truly circular cross-sectional shape. The front wall portion 41 includes erroneous assembly preventing insertion holes 43 at positions communicating with the respective erroneous assembly preventing seal holes 39.

Figure 8:
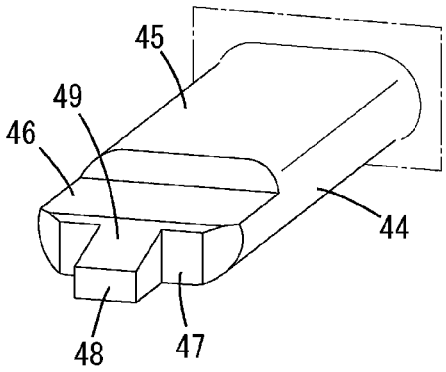
FIG. 8 is an enlarged perspective view of a detection piece in the front member.

Further, the front member 13 includes detection pieces 44 at positions corresponding to the respective detection-side seal holes 40. As shown in FIG. 8, the detection piece 44 includes a base end portion 45 in the form of a strip plate projecting rearward from the rear surface of the front wall portion 41 and a tip portion 46 vertically thinner than the base end portion 45. As shown in FIG. 2, the tip portion 46 is inserted into the space portion 20 and faces the locking lance 19 from below. As shown in FIG. 4, the base end portion 45 is inserted into and held in close contact with the detection-side seal hole 40.

As shown in FIG. 4, a cross-section (lateral cross-section, slice section) of the base end portion 45 has a circular shape, particularly an elliptical shape long in the lateral direction and short in the vertical direction to correspond to the detection-side seal hole 40. A width and a height of the base end portion 45 are larger than a width and a height of the detection-side seal hole 40 when the front seal 11 is in a natural state. Both left and right ends of the base end portion 45 are rounded into a semicircular shape as a whole.

As shown in FIG. 8, the base end portion 45 of the detection piece 44 is formed in a length range exceeding half the entire length of the detection piece 44. The width (lateral dimension) and the height (vertical dimension) of the base end portion 45 are set to be constant in the front-rear direction (length direction).

The tip portion 46 of the detection piece 44 includes an end surface portion 47 along the lateral direction and a detection body 45 projecting rearward from a laterally central part of the end surface portion 47. A slope portion 49 inclined toward a rear side is provided on the upper surface of the detection body 48.

As shown in FIG. 1, the front member 13 includes the tubular peripheral wall 28 projecting rearward from the outer periphery of the front wall portion 41. As shown in FIG. 2, upper and lower walls of the peripheral wall 28 are arranged to cover the covering portions 27 of the housing 10. As shown in FIGS. 1 and 7, the upper and lower walls of the peripheral wall 28 include front lock portions 50 at positions corresponding to the respective full locking portions 24. Each front lock portion 50 is provided with a front lock hole 51 extending in the front-rear direction. Further, the front lock portions 50 are also provided in left and right side walls of the peripheral wall 28.

<Rear Seal>

The rear seal 14 is made of rubber such as silicon rubber and includes, as shown in FIG. 2, a rear seal portion 52 facing the rear surface of the housing body 12. The rear seal portion 52 is in the form of a laterally long rectangular mat and can cover the rear surface of the housing body 12. As shown in FIG. 1, the rear seal 14 is formed to be one size larger than the front seal 11 in the front-rear, lateral and vertical directions.

A plurality of housing lips 53 are provided in the front-rear direction on the outer peripheral surface of the rear seal portion 52. Each housing lip 53 is provided over the entire periphery on the outer peripheral surface of the rear seal portion 52. As shown in FIG. 2, each housing lip 53 is arranged to face a fitting space 54 to be described later. A tubular receptacle 56 of a mating housing 55 as a connection partner of the housing 10 is held in close contact with each housing lip 53. The outer peripheral surface of the rear seal portion 52 serves as a sealing surface A for sealing between the both housings 10 and 55. The sealing surface A includes each housing lip 53.

Figure 3:
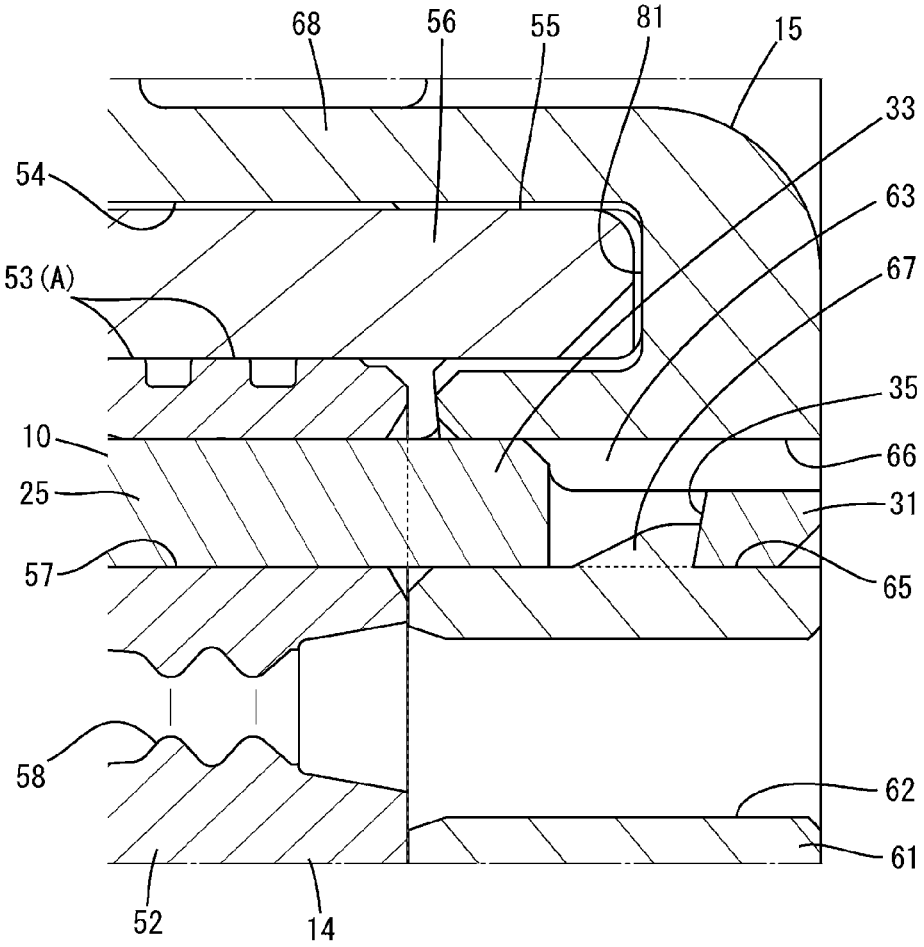
FIG. 3 is an enlarged view of a part where a sealing surface of a rear seal portion is in close contact with a receptacle of the mating housing and a part where a lock portion locks a lock receiving portion in FIG. 2.

As shown in FIG. 1, lock-side seal holes 57 are provided in upper and lower end parts of the rear seal portion 52. Each lock-side seal hole 57 is formed into a slit elongated in the lateral direction. As shown in FIG. 3, the base end side of the plate-like portion 25 is inserted into and held in close contact with the lock-side seal hole 57. As shown in FIG. 1, both left and right ends of the lock-side seal hole 57 are rounded into a semicircular shape to correspond to the base end side of the plate-like portion 25.

The rear seal portion 52 includes wire-side seal holes 58 at positions communicating with the respective cavities 17. The wire-side seal hole 58 has a circular cross-sectional shape, particularly a truly circular cross-sectional shape. Each wire-side seal hole 58 is arranged between upper and lower lock-side seal holes 57. As shown in FIG. 2, wires 59 are held in close contact with the wire-side seal holes 58.

The rear seal 14 includes positioning protrusions 60 at positions corresponding to the respective positioning holes 22. As shown in FIG. 1, each positioning protrusion 60 is in the form of a laterally long rib projecting forward from the front surface of the rear seal portion 52.

<Frame>

The frame 15 is made of synthetic resin and includes, as shown in FIG. 2, a rear wall portion 61 facing the rear surface of the rear seal portion 52. The rear wall portion 61 is in the form of a laterally long rectangular plate and can cover the rear surface of the rear seal portion 52.

The rear wall portion 61 includes insertion holes 62 at positions communicating with the respective wire-side seal holes 58. The insertion hole 62 has a rectangular cross-sectional shape. The wire 59 is inserted into the insertion hole 62.

Figure 9:
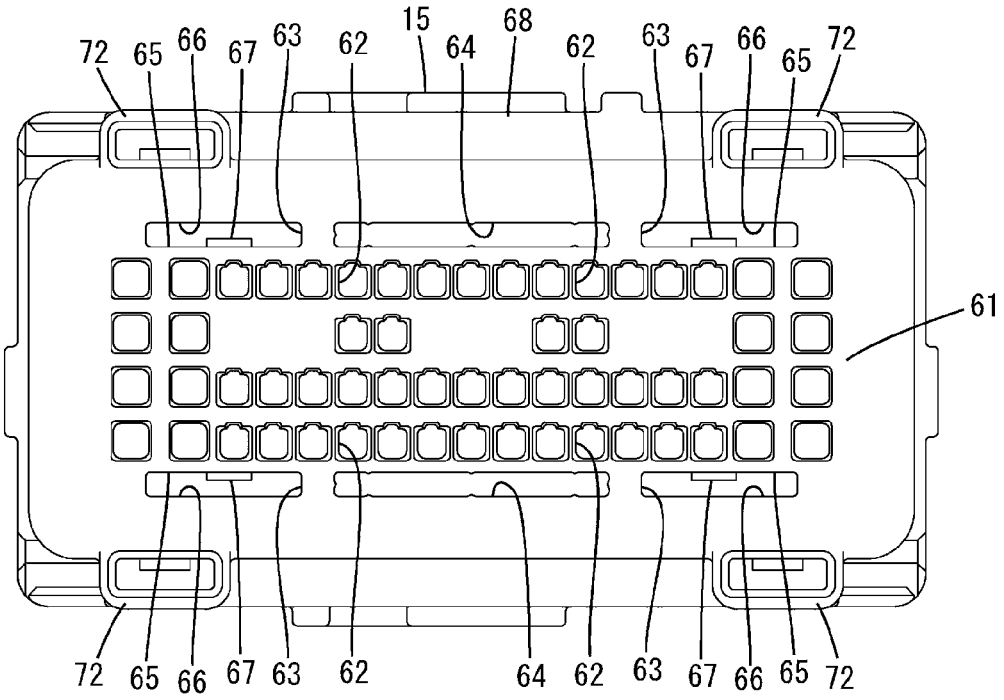
FIG. 9 is a back view of a frame.

As shown in FIG. 9, a plurality of through holes 63 and an intermediate through hole 64 are provided in each of upper and lower end parts of the rear wall portion 61. Each through hole 63 and each intermediate through hole 64 are formed into slits elongated in the lateral direction. The respective intermediate through holes 64 are arranged on laterally central sides of the upper and lower end parts of the rear wall portion 61. The intermediate plate portions 30 are inserted into the respective intermediate through holes 64. The respective through holes 63 are arranged on both left and right sides of the upper and lower end parts of the rear wall portion 61. As shown in FIG. 3, the lock portion 31 is inserted into the through hole 63.

As shown in FIG. 3, the inner surface of each through hole 63 has an inner part 65 on a vertically central side (side distant from the sealing surface A) and an outer part 66 on a vertical end side (side near the sealing surface A). The inner and outer parts 65, 66 constitute long-side parts of the slit-like through holes 63.

Figure 10:
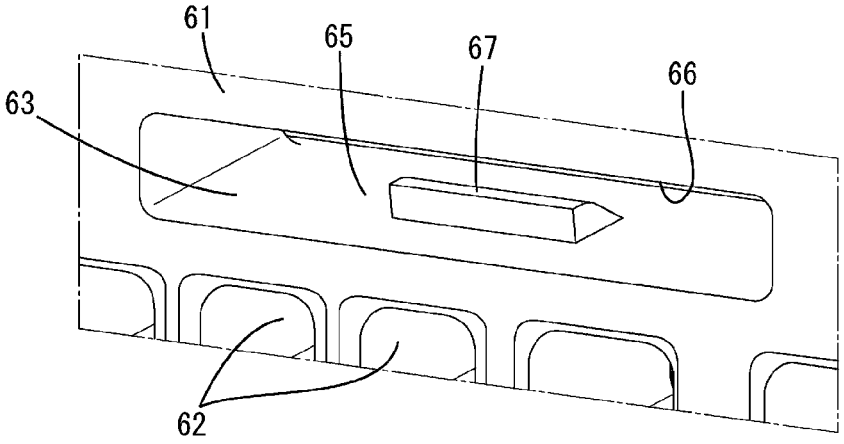
FIG. 10 is an enlarged perspective view of a through hole and the lock receiving portion in the frame.

As shown in FIGS. 9 and 10, the inner part 65 of each through hole 63 is provided with a lock receiving portion 67. The lock receiving portion 67 is in the form of a claw projecting in a central part of the inner part 65 of the through hole 62 in the front-rear and lateral directions. Specifically, the lock receiving portion 67 extends in the lateral direction and, as shown in FIG. 3, is shaped such that a front surface is inclined rearward and a rear surface is inclined rearward more gently than the front surface. The lock receiving portion 67 is fit into the lock hole 35 of the lock portion 31 to be locked. A space for allowing the deflection and deformation of the lock portion 31 is secured between a tip of the lock receiving portion 67 in a projecting direction and the outer part 66 of the through hole 63.

As shown in FIG. 1, the frame 15 includes a tubular fitting tube portion 68 projecting forward from the outer periphery of the rear wall portion 61. The fitting tube portion 68 is in the form of a laterally long rectangular tube and, as shown in FIG. 2, arranged to cover the outer periphery of the housing body 12. The fitting space 54 is provided to be open forward between the fitting tube portion 68 and the housing body 12. The receptacle 56 of the mating housing 55 is inserted into the fitting space 54.

As shown in FIG. 2, upper and lower walls of the fitting tube portion 68 are provided with lever accommodating portions 69. The lever accommodating portion 69 is formed into a groove extending in the lateral direction of the fitting tube portion 68 and open on the side of the fitting space 54 and on one lateral side. A later-described arm portion 70 of the lever 16 is inserted into the lever accommodating portion 69 through an opening on the one lateral side. The upper and lower walls of the fitting tube portion 68 are provided with locking portions 71 (see FIG. 1) for locking the lever 16. As shown in FIG. 9, mounting portions 72 for mounting an unillustrated wire cover are provided on both left and right end parts of upper and lower walls of the frame 15.

<Lever>

The lever 16 is made of synthetic resin and, as shown in FIG. 1, is gate-shaped in a front view and includes a pair of upper and lower arm portions 70 and a coupling portion 73 connecting end parts of the respective arm portions 70 on one lateral side. A pair of left and right cam grooves 74 are provided in each of the inner surfaces (mutually facing surfaces) of the respective arm portions 70. Each cam groove 74 includes a part extending in a direction inclined with respect to the front-rear direction and is open in the front end of the arm portion 70. Unillustrated cam followers of the mating housing 55 are inserted into the respective cam grooves 74 at the time of connecting the both housings 10, 55.

Although not shown in detail, the lever 16 is movable from an initial position to a connection position with respect to the housing 10 (fitting tube portion 68). At the initial position, the arm portions 70 are inserted in the lever accommodating portions 69 and the coupling portion 73 is arranged to project outward on the one lateral side of the fitting tube portion 68. At the initial position, the receptacle 56 of the mating housing 55 is lightly fit in the fitting space 54. Then, the cam followers of the mating housing 55 are inserted into the entrances of the cam grooves 74. In that state, the coupling portion 73 is pushed and the arm portions 70 are deeply inserted into the lever accommodating portions 69. While the lever 16 is moving from the initial position to the connection position, the cam followers slide on groove surfaces of the cam grooves 74 and a connecting operation of the both housings 10, 55 proceeds. When the lever 16 reaches the connection position, the cam followers reach back end sides of the cam grooves 74 and the both housings 10, 55 are properly connected. At this time, as shown in FIG. 2, the terminal fittings 18 are properly conductively connected to mating terminal fittings 75 mounted in the mating housing 55.

<Terminal Fittings, Mating Terminal Fittings, Mating Housing>

As shown in FIG. 2, the terminal fitting 18 is a female terminal fitting, includes a tubular box portion 76 and is connected to an end part of the wire 59. The mating terminal fitting 75 is a male terminal fitting and includes a tab 77 to be inserted into the box portion 76, and a lower end part thereof is connected to a circuit board 78. The tab 77 projects into the receptacle 56 of the mating housing 55. A back wall of the receptacle 56 is provided with projecting portions 79 having a circular cross-section and projecting at positions corresponding to the respective cavities 17. A base end side of the tab 77 (base end side of a part projecting into the receptacle 56) is press-fit into the projecting portion 79. As shown in FIG. 2, the projecting portion 79 is inserted into and held in close contact with the terminal-side seal hole 38. An outer diameter of the projecting portion 79 is larger than an inner diameter of the terminal-side seal hole 38 when the front seal 11 is in the natural state. Further, the back wall of the receptacle 55 is provided with erroneous assembly preventing protrusions 80 projecting at positions corresponding to the respective erroneous assembly preventing seal holes 39. The erroneous assembly preventing protrusions 80 have a larger projecting dimension than the tabs 77 in the receptacle 56.

<Connector Assembly Structure and Functions>

The front seal 11 is inserted inside the front member 13 and arranged to contact the rear surface of the front wall portion 41. The base end portions 45 of the detection pieces 44 are inserted into and held in close contact with the detection-side seal holes 40 (see FIG. 4). Any of the base end portions 45 and the detection-side seal holes 40 has an elliptical cross-sectional shape flat in the lateral direction and has no angular shapes such as right angular shapes on an outer edge. Thus, the base end portions 45 can receive resilient restoring forces uniform over the entire peripheries from the front seal 11 while being inserted in the detection-side seal holes 40.

The front member 13 is temporarily held at a partial locking position with respect to the housing 10. At the partial locking position, the partial locking portions 23 are fit into the front lock holes 51 in the front lock portions 50 on both left and right ends of the upper and lower walls and the rear ends of the respective front lock portions 50 contact the full locking portions 24, whereby movements in the front-rear direction of the front member 13 are restricted. At this time, the front wall portion 41 is arranged forward of the front surface of the housing body 12. The detection bodies 48 of the detection pieces 44 are arranged forward of the space portions 20.

In a rear part of the connector, the rear seal 14 is assembled on the rear surface side of the housing 10. The base end sides (including the base end sides of the lock pieces 33) of the upper and lower plate-like portions 25 are inserted into and held in close contact with the lock-side seal holes 57 of the rear seal 14. The lock portions 31 are arranged to project rearward from the rear surface of the rear wall portion 61. The rearward escape of the rear seal 14 is restricted by the contact of the rear seal 14 with the retaining projections 32. Further, the rear seal 14 is arranged to contact the rear surface of the housing body 12. The positioning protrusions 60 are inserted into the positioning holes 22 (see FIG. 2), whereby the rear seal 14 is prevented from being mounted on the housing 10 in a posture inverted in the front-rear and vertical directions.

Subsequently, the frame 15 is assembled with the housing 10 from behind. In the process of assembling the frame 15, the lock portions 31 enter the through holes 63 of the rear wall portion 61 and ride on the lock receiving portions 67 to be deflected and deformed. When the frame 15 is properly assembled, the lock portions 31 resiliently return and the lock receiving portions 67 are fit into the lock holes 35 of the lock portions 31. In this way, the lock portions 31 are locked to the lock receiving portions 67. The frame 15 is held on the housing 10 with the rear seal 14 sandwiched therebetween (see FIG. 2). The rear seal 14 is arranged to contact the front surface of the rear wall portion 61 and the rearward escape thereof is restricted.

The terminal fitting 18 is inserted into the cavity 17 successively through the insertion hole 62 of the rear wall portion 61 and the wire-side seal hole 58 of the rear seal 14 from behind. In the process of inserting the terminal fitting 18, the locking lance 19 interferes with the terminal fitting 18 to be deflected and deformed into the space portion 20. When the terminal fitting 18 is properly inserted, the locking lance 19 resiliently returns to retain and lock the terminal fitting 18 (see FIG. 2).

Subsequently, the front member 13 is pushed toward the housing body 12 and reaches a full locking position. The peripheral wall 28 of the front member 13 is arranged to cover the covering portions 27 of the housing body 12. The rear end of the peripheral wall 28 is arranged to face the steps 26. The peripheral wall 28 and the plate-like portions 25 (including the lock pieces 33) are arranged at positions overlapping each other in the vertical direction.

If the front member 13 reaches the full locking position, the full locking portions 24 are fit into the front lock holes 51 in the respective front lock portions 50 on the upper and lower walls and the front ends of the front lock portions 50 on the left and right side walls contact the partial locking portions 23, whereby movements of the front member 13 in the front-rear direction are restricted. The front seal 11 is arranged to contact the front surface of the housing body 12. Further, if the front member 13 reaches the full locking position, the detection bodies 48 of the detection pieces 44 enter the space portions 20 and the slope portions 49 of the detection bodies 48 are arranged to come into contact along the lower surfaces (surfaces facing the space portions 20, surfaces on sides toward which the locking lances 19 are deflected and deformed) of the locking lances 19 (see FIG. 2). In this way, the deflection of the locking lances 19 toward the space portions 20 is restricted and the terminal fittings 18 are doubly retained.

If the terminal fitting 18 is left incompletely inserted without being properly inserted into the cavity 17, a deflected state of the locking lance 19 is not released and the locking lance 19 remains to be arranged in the space portion 20. Thus, the detection body 48 of the detection piece 44 interferes with the locking lance 19 and the insertion thereof into the space portion 20 is restricted. As a result, the front member 13 is prevented from reaching the full locking position and the incompletely inserted state of the terminal fitting 18 can be detected.

Subsequently, the receptacle 56 of the mating housing 55 is inserted into the fitting space 54 and the connection of the both housings 10, 55 proceeds based on a sliding movement of the aforementioned lever 16. When the both housings 10, 55 are properly connected, the tip (opening end) of the receptacle 56 reaches a back side space (recess 81 retracted rearward) between the rear wall portion 61 and the fitting tube portion 68 in the frame 15 (see FIG. 2). The inner surface of the receptacle 56 is held in close contact with the sealing surface A of the rear seal 14 and the housing lips 53 are resiliently deformed into a compressed state between the receptacle 56 and the plate-like portions 25 of the housing 10 (see FIG. 3). By the resilient deformation of the housing lips 53, a pressing force acting inward (toward a vertical center) is applied to the plate-like portions 25 from the receptacle 56. The pressing force of the receptacle 56 is transmitted to the lock pieces 33 and serves as a force for displacing the tip sides of the lock portions 31 inwardly. Thus, a state where the tip sides of the lock portions 31 strongly contact the inner parts 65 and the lock receiving portions 67 are fit in the lock holes 35 of the lock portions 31 is satisfactorily maintained.

The erroneous assembly preventing protrusions 80 are inserted into the erroneous assembly preventing holes 21 through the erroneous assembly preventing seal holes 39 from the erroneous assembly preventing insertion holes 43 (see FIG. 2). If the housing 10 is in a vertically inverted posture with respect to the mating housing 55, the erroneous assembly preventing protrusions 80 cannot be inserted into the erroneous assembly preventing insertion holes 43 to prevent erroneous connection of the both housings 10, 55. At the time of erroneous connection of the both housings 10, 55, the erroneous assembly preventing protrusions 80 can interfere with the front wall portion 41 to avoid the interference of the tabs 77 with the front wall portion 41. Thus, the damage or breakage of the tabs 77 can be prevented.

The projecting portions 79 are inserted into the terminal-side seal holes 38 through the terminal-side insertion holes 42 and held in close contact with the terminal-side seal holes 38. Resilient restoring forces uniform in the circumferential directions are applied to the projecting portions 79 from the front seal 11. In the case of this embodiment, the terminal-side seal holes 38 are arranged adjacent to the detection-side seal holes 40 in the vertical direction, which is a short side direction of the detection-side seal holes 40 (see FIG. 4). Thus, the front seal 11 can ensure a thickness (distance) sufficient to obtain the resilient restoring force between the adjacent terminal-side seal holes 38 and detection-side seal holes 40.

As described above, with the both housings 10, 55 properly connected, sealing is provided in a liquid-tight manner around the wires 59 and between the both housings 10, 55 by the rear seal 14. Further, sealing is provided in a liquid-tight manner around connected parts of the terminal fittings 18 and the mating terminal fittings 75 by the front seal 11. Thus, according to this embodiment, the inside of the housing 10 can be reliably sealed and the electrical connection reliability of the both terminal fittings 18, 75 can be enhanced.

Technical features extracted from this embodiment are listed below.

The front seal portion 36 includes the detection-side seal holes 40 to be held in close contact with the base end sides of the detection pieces 44, and the base end sides of the detection pieces 44 have a circular cross-sectional shape, particularly an elliptical cross-sectional shape corresponding to the detection-side seal holes 40 (see FIG. 4). Thus, resilient restoring forces uniform in the circumferential direction can be applied to the base end sides of the detection pieces 44 from the front seal portion 36. As a result, the base end sides of the detection pieces 44 can be satisfactorily held in close contact with the detection-side seal holes 40.

In the front seal portion 36, the plurality of terminal-side seal holes 38 are arranged side by side and the plurality of detection-side seal holes 40 are arranged side by side at the positions adjacent to the terminal-side seal holes 38 in the arrangement direction of the terminal-side seal holes 38. The base end sides of the detection pieces 44 have such an elliptical cross-sectional shape long in the lateral direction, which is a direction orthogonal to the arrangement direction of the terminal-side seal holes 38, and short in the vertical direction, which is the arrangement direction. Thus, the front seal portion 36 can ensure a sufficient thickness (distance) between the detection-side seal holes 40 and the terminal-side seal holes 38 in the arrangement direction of the terminal-side seal holes 38. As a result, the front seal portion 36 can obtain sufficient resilient restoring forces between the detection-side seal holes 40 and the terminal-side seal holes 38 and can meet, for example, a request for miniaturization.

The housing 10 includes the lock pieces 33 projecting rearward, the rear seal portion 52 includes the sealing surface A to be held in close contact with the mating housing 55 and the lock-side seal holes 57 to be held in close contact with the base end sides of the lock pieces 33, the rear wall portion 61 of the frame 15 includes the lock receiving portions 67 to be locked by the lock portions 31 on the inner surfaces of the through holes 63, and the lock receiving portions 67 are provided on the inner parts 65 distant from the sealing surface A on the inner surfaces of the through holes 63 (see FIG. 3). Thus, if the mating housing 55 is held in close contact with the sealing surface A to apply an inward deformation force to the rear seal portion 52, the base end sides of the lock pieces 33 are displaced inwardly. Thus, the lock portions 31 on the tip sides can strongly lock the lock receiving portions 67 provided on the inner parts 65 of the through holes 63. As a result, a state where the rear seal portion 52 is arranged between the housing 10 and the rear wall portion 61 can be satisfactorily maintained.

The lock portions 31 are plate-like and include the lock holes 35, and the lock receiving portions 67 are formed into a projection shape to be fit into the lock hole 35. Thus, when the mating housing 55 is held in close contact with the sealing surface A, the plate-like lock portions 31 can satisfactorily receive a resilient restoring force of the rear seal portion 52. Therefore, the sealability of the rear seal portion 52 can be stably maintained.

The covering portions 27 and the steps 26 are provided on the outer peripheral surface of the housing 10, the peripheral wall 28 of the front member 13 is arranged on the covering portions 27, the steps 26 are facing the tip of the peripheral wall 28 and the lock pieces 33 are provided to be continuous with rear sides of the steps 26 (see FIG. 2). Thus, parts of the housing 10 behind the steps 26 can be effectively utilized as formation regions of the lock pieces 33.

Other Embodiments of Present Disclosure

The embodiment disclosed this time should be considered illustrative in all aspects, rather than restrictive.

Although the rear wall portion is provided on the frame contributing to the connection of the mating housing in the case of this embodiment, a rear wall portion may be provided merely as a rear member for retaining a rear seal as another embodiment.

Although the connector includes the slide-type lever in the case of this embodiment, a connector may include a rotary-type lever as another embodiment. Further, the technique of the present disclosure can also be applied to connectors provided with no lever.

Although the base end side of the plate-like portion is provided integrally and continuously in the width direction in the case of this embodiment, base end sides of plate-like portions may be provided in a divided manner in a width direction and each may be provided with an independent lock piece as another embodiment.

Although the front member is provided to be movable to the partial locking position and the full locking position with respect to the housing body in the case of this embodiment, a front member may be fully locked (state where detection pieces enter space portions) with respect to a housing body without having a partial locking position as another embodiment.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a housing;

a rear seal portion to be arranged to face a rear surface of the housing; and a rear wall portion to be arranged to face a rear surface of the rear seal portion, wherein:

the housing includes a lock piece projecting rearward from the rear surface of the housing and the lock piece includes a lock portion on a tip side of the lock piece, the rear seal portion includes a lock-side seal hole to be held in close contact with a base end side of the lock piece and a sealing surface to be held in close contact with a mating housing as a connection partner of the housing on an outer peripheral side of the rear seal portion, the rear wall portion includes a through hole, the tip side of the lock piece being arranged in the through hole, and a lock receiving portion to be locked by the lock portion on an inner surface of the through hole, out of an outer part near the sealing surface and an inner part distant from the sealing surface on the inner surface of the through hole, the lock receiving portion is provided on the inner part, and when the mating housing is held in contact with the sealing surface to apply an inward deformation force to the real seal portion, the based end side of the lock piece are displaced inwardly and the lock portion locks the lock receiving portion provided on the inner part of the through hole.

2. The connector of claim 1, wherein:

the lock portion is plate-like and includes a lock hole, and the lock receiving portion has a projection shape to be fit into the lock hole.

3. The connector of claim 1, wherein the housing includes, on an outer peripheral surface of the housing, a covering portion and a step arranged to face forward on a rear side of the covering portion, a peripheral wall of a front member is arranged on the covering portion, the step is facing a tip of the peripheral wall, and the lock piece is provided to be continuous with a rear side of the step.

4. The connector of claim 1, wherein the lock piece has a laterally extending stepped surface on the lock portion.

5. The connector of claim 4, wherein the lock portion is vertically deflectable and deformable with a part on a side of the stepped surface as a fulcrum.

6. The connector of claim 1, wherein the lock-side seal hole is provided in an end part of the rear seal portion.

7. The connector of claim 1, wherein a space for allowing deflection and deformation of the lock portion is secured between a tip of the lock receiving portion in a projecting direction and an outer part of the through hole.

* * * * *